US007983389B2

(12) United States Patent
Ollinger et al.

(10) Patent No.: US 7,983,389 B2
(45) Date of Patent: Jul. 19, 2011

(54) X-RAY OPTICAL ELEMENT AND DIFFRACTOMETER WITH A SOLLER SLIT

(75) Inventors: Christoph Ollinger, Karlsruhe (DE); Norbert Kuhnmuench, Pfinztal (DE)

(73) Assignee: Bruker AXS GmbH, Karlsruhe (DE)

( * ) Notice: Subject to any disclaimer, the term of this patent is extended or adjusted under 35 U.S.C. 154(b) by 85 days.

(21) Appl. No.: 12/591,610

(22) Filed: Nov. 25, 2009

(65) Prior Publication Data

US 2010/0135460 A1 Jun. 3, 2010

(30) Foreign Application Priority Data

Dec. 2, 2008 (DE) ..... 10 2008 060 070

(51) Int. Cl.
*G21K 1/06* (2006.01)

(52) U.S. Cl. ..... 378/84; 378/147

(58) Field of Classification Search ..... 378/71, 378/84, 85, 147, 149, 150
See application file for complete search history.

(56) References Cited

U.S. PATENT DOCUMENTS 6,266,392 B1 7/2001 Fujinawa
6,307,917 B1 * 10/2001 Shimizu et al. ..... 378/145
6,444,993 B1 * 9/2002 Kogan ..... 250/505.1
6,665,372 B2 12/2003 Bahr
6,807,251 B2 10/2004 Okanda
2005/0281382 A1 12/2005 Inneman
2007/0086567 A1 4/2007 Kataoka
2008/0056452 A1 3/2008 Sasaki
2008/0084967 A1 * 4/2008 Matsuo et al. ..... 378/149

OTHER PUBLICATIONS

"Diffraction Solutions D8 Advance" Company Broshure, Bruker AXS, Karlsruhe Germany, 2002.

* cited by examiner

*Primary Examiner* — Hoon Song
(74) *Attorney, Agent, or Firm* — Paul Vincent

(57) ABSTRACT

An X-ray optical element (1, 1', 1") with a Soller slit comprising several lamellas for collimating an X-ray beam with respect to the direction of the axis (5, 15) of the Soller slit, and a further collimator for delimiting an X-ray (10), wherein the further collimator is rigidly connected to the Soller slit (2, 14) during operation, is characterized in that the X-ray beam (10) delimited by the further collimator intersects the axis (5, 15) of the Soller slit within the Soller slit, and the direction of the X-ray beam (10) subtends an angle $\alpha \geqq 10°$ with respect to the axis (5, 15) of the Soller slit. An X-ray optical element (1, 1', 1") with a Soller slit (2, 14) and a further collimator is thereby realized, which permits automatic change between the Soller slit (2, 14) and the further collimator.

25 Claims, 3 Drawing Sheets

X-RAY OPTICAL ELEMENT AND DIFFRACTOMETER WITH A SOLLER SLIT

This application claims Paris Convention priority of DE 10 2008 060 070.9 filed Dec. 2, 2008 the complete disclosure of which is hereby incorporated by reference.

BACKGROUND OF THE INVENTION

The invention concerns an X-ray optical element with a Soller slit comprising several lamellas for collimating an X-ray beam with respect to the direction of the axis of the Soller slit, and with a further collimator for delimiting an X-ray beam, wherein the further collimator is rigidly connected to the Soller slit during operation.

X-ray diffractometry can be used for various analytical tasks, for which different measuring geometries are used, e.g. Bragg-Brentano or parallel beam geometry. However, different optical elements are required in the optical path for this purpose. In order to permit fast change between the different measuring geometries, it is desired to minimize the necessary modifications.

U.S. Pat. No. 6,807,251 B2 discloses an X-ray diffractometer with a parabolic mirror for use of the diffractometer in parallel beam geometry, and a slit collimator for delimiting the X-ray beam in the Bragg Brentano geometry. The mirror and the slit collimator are rigidly connected to each other. A rotatable path selection disc having a slit is disposed behind the aperture/mirror unit, through rotation of which the X-ray beam (parallel or divergent) required for the corresponding geometry can be selected.

U.S. Pat. No. 6,665,372 B2 discloses an X-ray diffractometer, in which the X-ray radiation can be guided in sections along different beam paths for different tasks, wherein one beam path extends in a straight line through a collimator system having adjustable and/or exchangeable collimators, from the sample to the X-ray detector, while the other beam path has a bend and extends initially from the sample position to a dispersive or reflecting X-ray optical element, and from there to the X-ray detector. The bent beam path can be collimated out with respect to the detector by means of a shutter collimator. The collimator and the dispersive or reflecting X-ray optical element are rigidly aligned with respect to each other and can be pivoted together with respect to the sample.

These arrangements are disadvantageous in that the X-ray beam is divided and for this reason, only part of the radiation emitted by the X-ray source can be used for each application. Moreover, the conventional arrangements require a relatively large amount of space in order to be able to realize the various beam paths.

In particular, for measurements in parallel beam geometry, the use of Soller slits is advantageous to delimit vertical and/or horizontal divergences of X-rays. Linear Soller slits are described in detail e.g. in U.S. Pat. No. 6,266,382 B1, US2005/0281382 A1 and U.S. Pat. No. 6,307,917 B1.

Bruker Advanced X-ray solutions "Diffraction Solutions D8 Advance" 2002 discloses an X-ray diffractometer for reflection and transmission measurements in parallel beam geometry. The X-ray beam emitted by the sample thereby extends through a linear or a radial Soller slit.

U.S. Pat. No. 6,307,917 B1 discloses an X-ray apparatus with Soller slit for collimating divergent X-rays. The Soller slit is part of a monochromator unit with a monochromator collimator, which is used to delimit the X-ray beam that is subsequently collimated by the Soller slit.

It is the object of the invention to propose an X-ray optical element with a Soller slit and a further collimator, which enables automatic change between the Soller slit and the further collimator.

SUMMARY OF THE INVENTION

This object is achieved in accordance with the invention in that the X-ray beam delimited by the further collimator intersects the axis of the Soller slit within the Soller slit and the direction of the X-ray beam delimited by the further collimator subtends an angle of $\alpha \geqq 10°$ with respect to the axis of the Soller slit.

An X-ray beam emitted from the radiation source can thereby either be delimited by the Soller slit or by the further collimator, depending on the angle at which the Soller axis is adjusted with respect to the direction of the incident X-ray beam. When the X-ray beam is incident parallel or at a small angle (<10°) with respect to the Soller axis, it passes through the Soller slit. The larger the difference between the direction of the incident X-ray beam and the direction of the Soller axis, the larger the amount of radiation that passes through the further collimator.

The directions of the X-rays delimited by the Soller slit and the further collimator intersect within the Soller slit. For this purpose, the Soller slit has a beam window that permits passage of X-ray radiation in one direction that subtends an angle of $\alpha \geqq 10°$ with respect to the axis of the Soller slit. In this fashion, a very compact and flexible optical element is realized.

The "axis of the Soller slit" defines a symmetrical axis of the Soller slit, which extends in the direction of the X-ray (optical axis) that is to be collimated by the Soller slit, i.e. with a linear Soller slit, the Soller axis extends parallel to the lamellas of the Soller slit between an inlet opening and an outlet opening. With a radial Soller slit, the Soller axis extends along the mirror plane of the Soller slit between an inlet opening and an outlet opening.

The inventive optical element permits adjustment of the optical set-up of a diffractometer to the application required for the sample or the task (e.g. Bragg-Brentano, Powder-GID, reflectometry).

In one embodiment of the inventive X-ray optical element, the Soller slit is a linear Soller slit. A linear Soller slit comprises a plurality of thin lamellas (e.g. metal foils), which are disposed parallel to and at a separation from each other. Linear Soller slits are used, in particular, in connection with point detectors.

In another embodiment of the inventive X-ray optical element, the Soller slit is a radial Soller slit. In a radial Soller slit, the lamellas are not parallel but orientated in a radial direction with respect to a center within a certain angle range (overall opening angle=angle between the first and last lamella). The separation between the individual lamellas defines the divergence angle of the radial Soller slit. Radial Soller slits are used, in particular, in connection with strip detectors.

In a further development of the embodiment with a linear Soller slit, the lamellas of the linear Soller slit are disposed parallel with respect to the beam direction of the X-ray delimited by the further collimator. In this arrangement, both the X-ray delimited by the further collimator and also an X-ray extending in the direction of the Soller axis can extend through the Soller slit (in different directions).

It may also be advantageous for the Soller slit to have a recess perpendicular to the Soller axis. The X-ray delimited by the further collimator can thereby intersect the axis of the Soller slit within the Soller slit independently of the orientation of the lamellas of the Soller slit.

The Soller slit may alternatively comprise two partial collimators, wherein the further collimator is disposed at least partially between the two partial collimators. However, the two partial collimators of the Soller slit must then be exactly adjusted.

In one particularly advantageous embodiment, the further collimator has at least two collimator jaws, wherein the collimator jaws are disposed on different sides of the Soller slit. It is particularly advantageous to dispose one collimator jaw on the side of the Soller slit that faces the X-ray beam incident on the further collimator, and to dispose the other collimator jaw on the side facing away from the X-ray beam incident on the further collimator.

It is thereby particularly advantageous for the collimator jaws to subtend an angle which differs from 90°, preferably 45°, with respect to the axis of the Soller slit.

The overall further collimator may alternatively also be disposed on one side of the Soller slit, in particular, be manufactured in one piece. In this case, an aperture collimator may e.g. be used.

The further collimator is preferably made from tantalum.

It is also advantageous for the geometry of the further collimator, in particular, the collimator opening, to be adjustable in the non-operating state. The cross-section of the X-ray beam emerging from the further collimator is thereby well defined.

In a further embodiment of the inventive X-ray optical element, the further collimator is a linear Soller slit. The X-ray optical element of this embodiment has two Soller slits, the axes of which are disposed at an angle $\alpha \geqq 10°$. The two Soller slits cross each other such that at least one of the Soller slits has a recess within which the other Soller slit is at least partially disposed.

In an advantageous further development of the embodiment with two linear Soller slits, the two linear Soller slits have different divergence angles, i.e. the separations between the lamellas of the two linear Soller slits are different.

The further collimator may moreover be a radial Soller slit. This is particularly advantageous when strip detectors are used.

In a special further development of this embodiment, the inventive optical element has two radial Soller slits with different opening angles.

The invention also concerns a diffractometer with a source for generating a primary beam, a sample holder for arranging a sample, a detector for detecting a secondary beam emitted by the sample, and an X-ray optical element as described above.

In a preferred embodiment of the inventive diffractometer, the X-ray optical element is installed in the diffractometer such that it can be rotated about an axis of rotation perpendicular to the axis of the Soller slit. The inlet opening of the Soller slit can thereby be moved out of the optical path through rotation and at the same time, the beam window of the further collimator can be moved into the optical path. It is thereby not necessary to divide the incident X-ray beam into two beam paths, rather the X-ray optical element can be orientated through rotation in such a fashion that optimum irradiation is obtained for any geometry.

A motor for rotating the X-ray optical element is preferably provided. For this purpose, the X-ray optical element is mounted to the motor axis. In correspondence with the setting of the motor, the size of the opening defined by the further collimator can be varied perpendicularly to the X-ray (clearance height of the further collimator).

A particularly preferred embodiment comprises automatic control of the rotation of the X-ray optical element, in particular, computer control.

The X-ray optical element is preferably disposed on the side of the secondary beam, e.g. for changing between Bragg-Brentano (further collimator in the beam) and reflectometry (linear Soller slit in the beam).

Alternatively or additionally, the X-ray optical element may also be disposed on the side of the primary beam, e.g. for changing between Bragg-Brentano on flat powder samples (further collimator in the beam) and reflection measurements on uneven powder samples (linear Soller slit in the beam).

When an embodiment of the inventive optical element with at least one radial Soller slit is used, the radial Soller slit may be orientated differently with respect to the further components of the diffractometer.

When the X-ray optical element is disposed on the secondary side, it may be advantageous for the detector to be disposed at the point of intersection of the lamella directions of at least one radial Soller slit of the X-ray optical element. The direction of the lamellas extends in the plane defined by the corresponding lamella along the center line of the lamella (in the direction of propagation of the collimated X-ray). Arrangement of the detector in the point of intersection of the Soller slit lamellas is particularly advantageous e.g. for transmission measurements with focussing primary beam.

Independently of the arrangement of the X-ray optical element, it may be advantageous to dispose the sample holder at the point of intersection of the lamella directions of at least one radial Soller slit of the X-ray optical element. Arrangement of the sample holder at the point of intersection of the Soller slit lamellas is particularly advantageous for transmission measurements on capillary samples with strip detectors.

When the X-ray optical element is disposed on the primary side, it may also be advantageous for the source to be disposed in the center of at least one radial Soller slit of the X-ray optical element. Arrangement of the source in the point of intersection of the Soller slit lamellas is particularly advantageous for measurements in a Bragg-Brentano arrangement, which attach particular importance to suppression of stray radiation.

Further advantages of the invention can be extracted from the description and the drawing. The features mentioned above and below may be used individually or collectively in arbitrary combination. The embodiments shown and described are not to be understood as exhaustive enumeration but have exemplary character for describing the invention.

DESCRIPTION OF THE PREFERRED EMBODIMENT

Figure 1A:
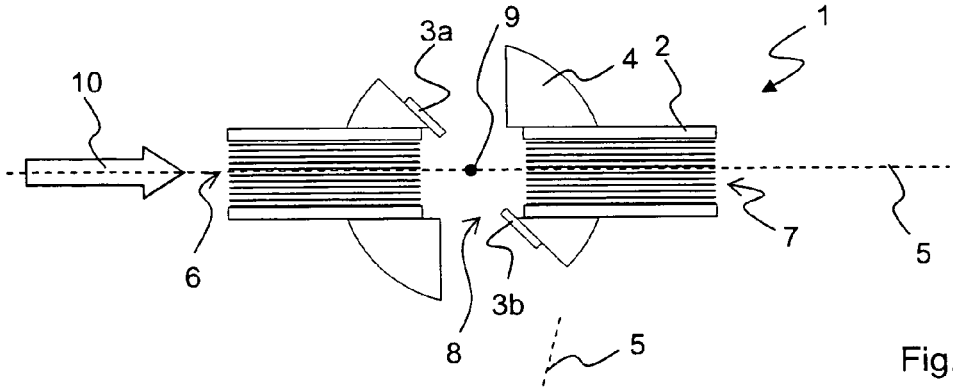
FIGS. 1*a-c* show sectional views of an inventive X-ray optical element in different orientations with respect to the incident X-ray beam with linear Soller slit and further collimator with collimator jaws.
Figure 1B:
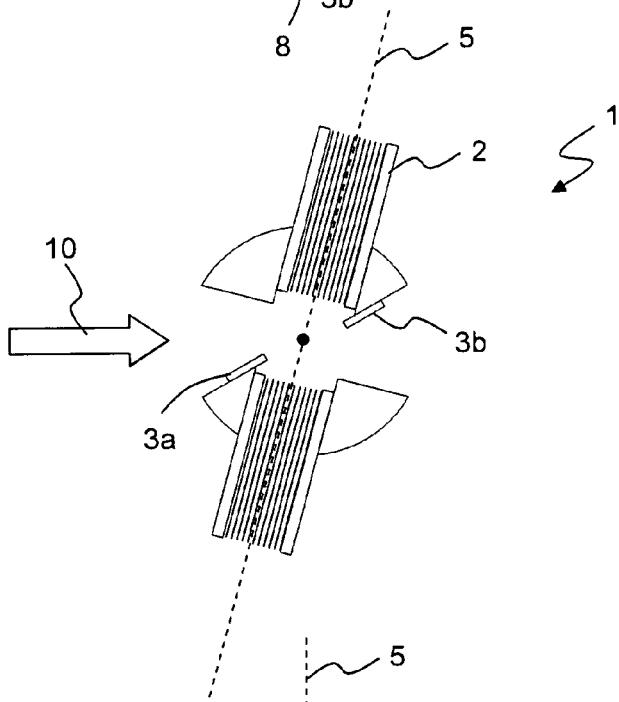
Figure 1C:
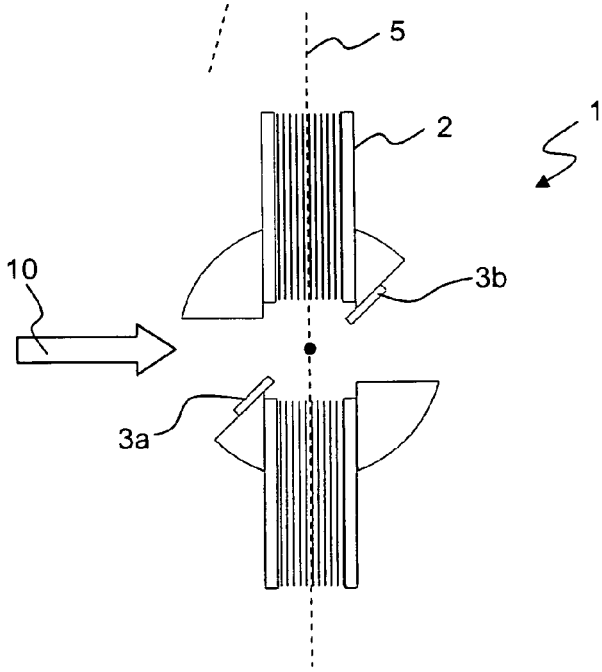
Figure 2:
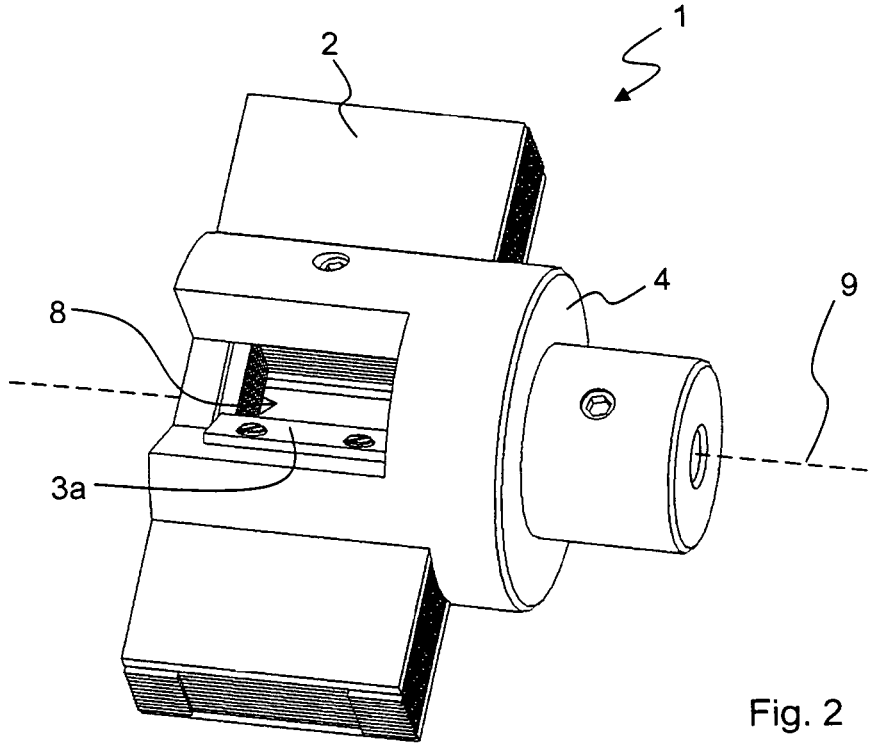
FIG. 2 shows a perspective view of the X-ray optical element of FIG. 1.

FIGS. 1*a-c* and FIG. 2 show a particularly preferred embodiment of an inventive optical element 1 with a linear Soller slit 2 (equatorially disposed Soller slit) and a further collimator comprising two collimator jaws 3*a*, 3*b*, e.g. in the form of tantalum blades. The collimator jaws 3*a*, 3*b* and the Soller slit 2 are mounted to a holder 4, thereby rigidly connecting the further collimator to the Soller slit 2. The Soller slit 2 has a Soller axis 5 that extends between an inlet opening 6 and an outlet opening 7, parallel to the lamellas of the Soller slit. The plane formed by the collimator jaws 3*a*, 3*b* of the further collimator subtends an angle differing from 90°, preferably >10°, in the present case 45°, with respect to the axis 5 of the Soller slit. The separation between the collimator jaws 3*a*, 3*b* can be changed in the non-operating state by moving the collimator jaws 3*a*, 3*b*. The Soller slit 2 has a beam window in the form of a recess 8 through which radiation having a direction of propagation that does not extend along the Soller axis 5 can pass through the X-ray optical element 1 (FIG. 1*b*, 1*c*). In an alternative fashion, a beam window may also be realized in that the optical path extends both through the lamellas of the Soller slit 2 and also through the further collimator (not shown) through suitable orientation of the lamellas of the Soller slit 2 when the X-ray optical element 1 is rotated with respect to the Soller axis 5. The lamellas of the Soller slit 2 of FIG. 1*a*-1*c* would then be orientated parallel to the plane of the drawing.

FIG. 1*a* shows an orientation of the inventive X-ray optical element with respect to an incident X-ray beam 10 (as used below, the designation "X-ray beam 10" also includes bundled beams), wherein the Soller slit 2 is disposed parallel to the X-ray beam 10. The X-ray beam 10 is then collimated by the Soller slit 2.

The X-ray optical element 1 can be rotated with respect to the incident X-ray beam 10 through rotation of the X-ray optical element 1 about an axis of rotation 9. The axis of rotation 9 of the X-ray optical element 1 is thereby perpendicular to the Soller axis 5 and to the incident X-ray beam 10 in any position of the X-ray optical element 1. The inventive X-ray optical element 1 permits selection between an optical path through the Soller slit 2 or an optical path through the further collimator without thereby deflecting or dividing the X-ray beam 10. Relative to the reference system of the X-ray optical element 1, the optical path extending through the further collimator intersects the optical path extending through the Soller slit 2 within the Soller slit 2. This realizes a compact design of the X-ray optical element 1.

FIGS. 1*b*, 1*c* show two different positions of the X-ray optical element 1 with respect to the incident X-ray beam 10, wherein the X-ray beam 10 is delimited (collimated down) by the further collimator. The clearance height (with respect to the incident X-ray beam 10) of the further collimator, which is delimited by the collimator jaws 3*a*, 3*b*, can be varied through different angle positions of the Soller axis 5 with respect to the incident X-ray beam 10. This is clearly shown in FIGS. 1*b*, 1*c*. In the present embodiment, maximum passage of the X-ray beam 10 through the further collimator is obtained in a position rotated through 90° with respect to the position of FIG. 1*a* (position with optical path parallel to the Soller axis 5).

The use of the inventive X-ray optical element in a diffractometer permits automatic change between a Bragg-Brentano optical path, in which the single further collimator delimits the X-ray beam 10, and a parallel optical path through the Soller slit 2. This enables investigation of the most different of powder samples with one assembly and without readjustment of the device. In connection with a parallel primary beam, reflectometry measurements can moreover be realized, in which an assembly with single collimator (e.g. with collimator jaws 3*a*, 3*b*) is selected for small angles of incidence, i.e. in the region of intensive reflexes. For large angles of incidence, i.e. in the region of weak intensities, it is possible to automatically change to an optical path with Soller slit 2 in order to increase the intensity yield of the sample. In this case, it is also possible to realize a change between measurements along the specular axis of the sample with high resolution, i.e. with small opening of the further collimator, and measurements of the diffuse and low-luminosity stray signal of the sample under grazing incidence, i.e. with Soller slit 2, with one single assembly.

Figure 3:
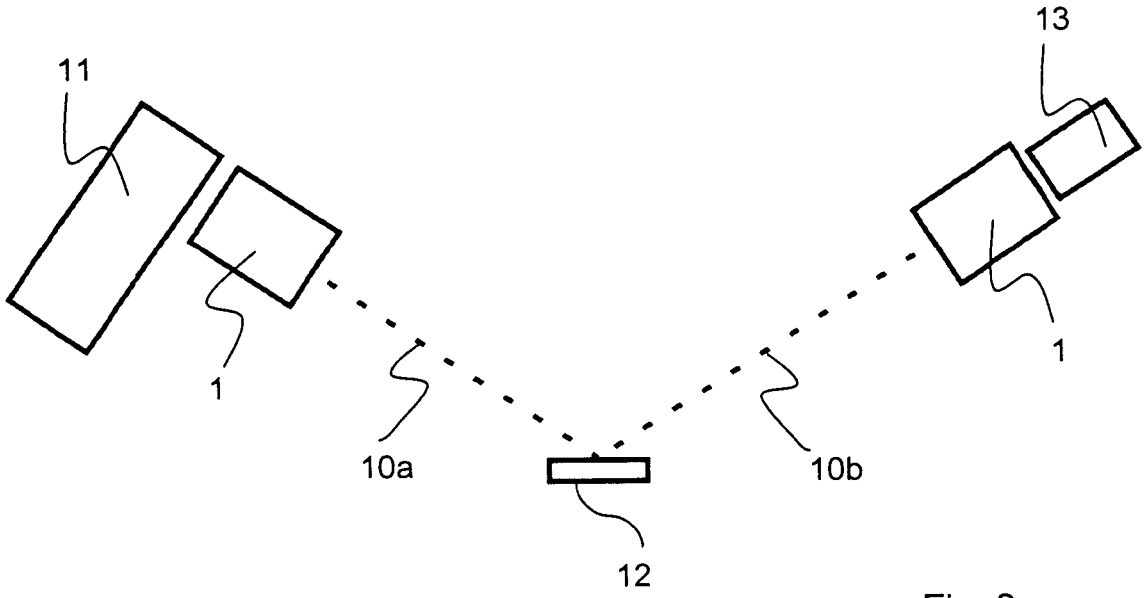
FIG. 3 shows a schematic view of an inventive diffractometer.

FIG. 3 shows a schematic assembly of an inventive diffractometer of this type with an X-ray source 11, a sample holder 12, a detector 13, and two inventive X-ray optical elements 1, wherein one of the X-ray optical elements is disposed on the side of the primary beam and the other is disposed on the side of the secondary beam. The X-ray optical elements 1 are mounted to a goniometer and are disposed to be rotatable with respect to the X-ray source 11, the sample holder 12, and the detector 13. Rotation of the X-ray optical elements 1 is advantageously realized in each case by means of a motor (not shown). The optical axis (direction of the X-ray beam 10) extends through the axis of rotation of the X-ray optical element 1 or the motor. It is also possible to only provide one optical element 1, i.e. either on the side of the primary beam or on the side of the secondary beam.

Other embodiments of the inventive X-ray optical element may also be used in the primary beam 10*a* and/or in the secondary beam 10*b* instead of the X-ray optical element 1 shown in FIGS. 1*a*-*c* and FIG. 2.

Figure 4:
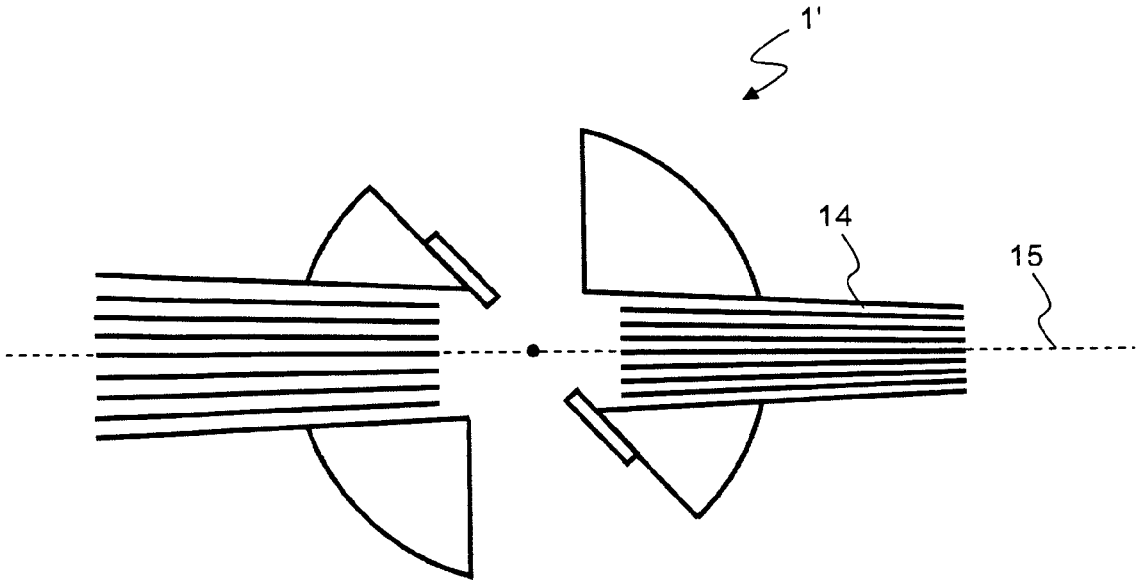
FIG. 4 shows a sectional view of an inventive X-ray optical element with a radial Soller slit and a further collimator with collimator jaws.

As shown in FIG. 4, the inventive X-ray optical element 1' may thereby e.g. have a radial Soller slit 14 instead of a linear Soller slit 2. This embodiment of the X-ray optical element 1' can be used for a change between e.g. transmission measurements with capillaries and strip detector (use of the radial Soller slit 14) and Bragg-Brentano measurements in reflection geometry (use of the further collimator with collimator jaws 3*a*, 3*b*). Depending on the application, it may be advantageous to arrange the source 11, the sample holder 12 or the detector 13 in the center of the radial Soller slit 14, wherein the point of intersection between the lamellas of the radial Soller slit 14 and the axis 15 of the radial Soller slit 14 is defined as the center of the radial Soller slit 14.

Figure 5:
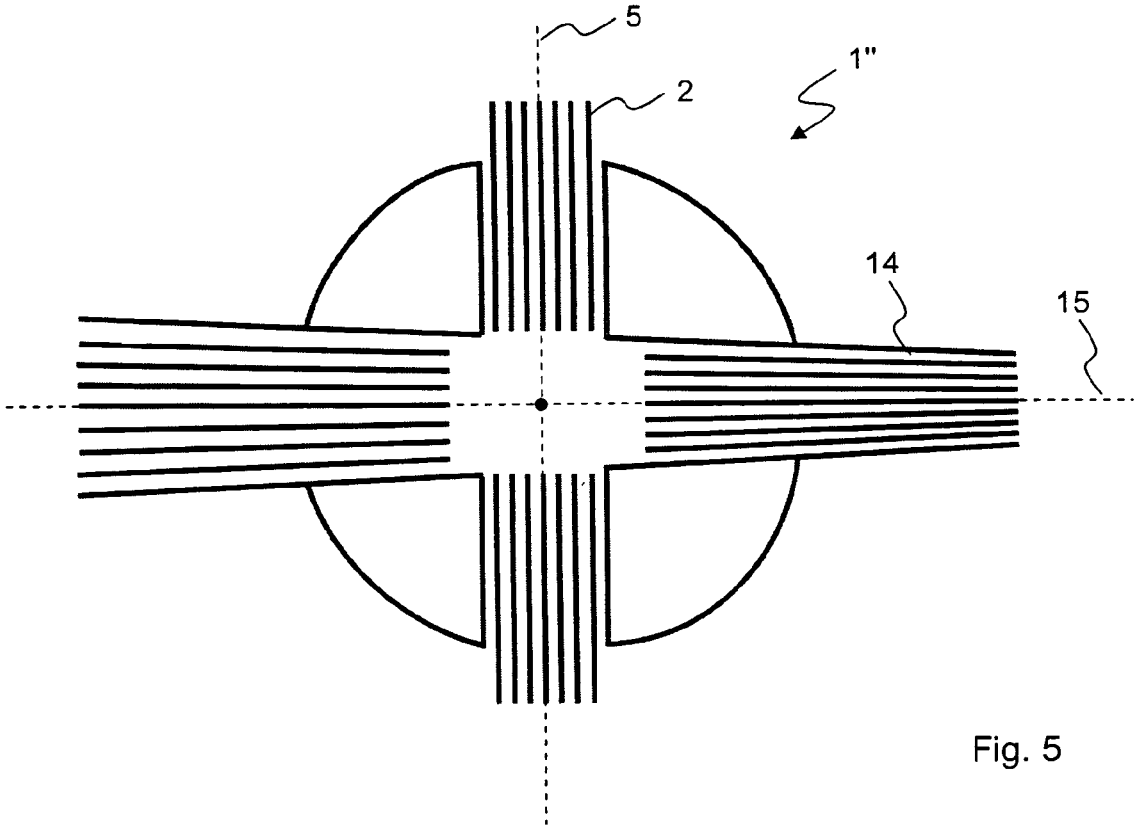
FIG. 5 shows a sectional view of an inventive X-ray optical element with a linear Soller slit and a radial Soller slit as further collimator.

FIG. 5 shows a further embodiment of the inventive X-ray optical element 1", in which a linear Soller slit 2 and a radial Soller slit 14 are combined. The axis 5 of the linear Soller slit 2 and the axis 15 of the radial Soller slit 14 are preferably perpendicular with respect to each other. This embodiment of the inventive X-ray optical element 1" is used to adjust the optical path for automatic change between transmission measurements and reflection measurements with powder samples, in particular, for a change between capillary samples with strip detector (use of the radial Soller slit 2) and flat samples with point detectors (use of the linear Soller slit 14).

Moreover, it is also possible to combine two linear Soller slits 2 (not shown). When the lamellas of the two linear Soller slits 2 are perpendicular with respect to each other and perpendicular with respect to the Soller axis 5, an X-ray optical element of this type can be used for changing between applications, in which both measurements in the stray plane and also measurements from the stray plane are carried out.

It is also possible to combine more than two collimators within one X-ray optical element in a corresponding fashion.

All embodiments of the inventive diffractometer can also be used for neutron beam diffractometry.

The inventive diffractometer realizes automatic change between a Soller slit and at least one further collimator without engagement by the user and without readjustment.

LIST OF REFERENCE NUMERALS

1 X-ray optical element
2 Soller slit (linear)
3*a*,3*b* collimator jaws of the further collimator
4 holder
5 Soller axis of the linear Soller slit
6 inlet opening of the Soller slit
7 outlet opening of the Soller slit
8 recess in the Soller slit
9 axis of rotation of the X-ray optical element
10 X-ray beam
10*a* primary beam
0*b* secondary beam
11 X-ray source
12 sample holder
13 detector
14 radial Soller slit
15 axis of the radial Soller slit

We claim:

1. An X-ray optical element for collimating an X-ray beam, the element comprising:

a Soller slit having an axis defined by a plurality of lamellas, said lamellas collimating the X-ray beam with respect to a direction of said axis; and a collimator for delimiting the X-ray beam, said collimator being rigidly connected to said Soller slit during operation of the optical element, wherein the X-ray beam delimited by said collimator intersects said axis of said Soller slit within said Soller slit, a direction of the X-ray beam thereby subtending an angle $\alpha \geqq 10°$ with respect to said axis of said Soller slit.

2. The X-ray optical element of claim 1, wherein said Soller slit is a linear Soller slit.

3. The X-ray optical element of claim 1, wherein said Soller slit is a radial Soller slit.

4. The X-ray optical element of claim 2, wherein said lamellas of said linear Soller slit are disposed parallel to a direction of the X-ray beam delimited by said collimator.

5. The X-ray optical element of claim 1, wherein said Soller slit has a recess perpendicular to said Soller slit axis.

6. The X-ray optical element of claim 1, wherein said Soller slit comprises two partial slits, wherein said collimator is at least partially disposed between said two partial slits.

7. The X-ray optical element of claim 1, wherein said collimator has at least two collimator jaws, said collimator jaws being disposed on different sides of said Soller slit.

8. The X-ray optical element of claim 7, wherein said collimator jaws subtend an angle with respect to said axis of said Soller slit which differs from 90° or an angle of 45°.

9. The X-ray optical element of claim 1, wherein said collimator is disposed on one side of said Soller slit.

10. The X-ray optical element of claim 9, wherein said collimator is made in one piece.

11. The X-ray optical element of claim 1, wherein said collimator is made from tantalum.

12. The X-ray optical element of claim 1, wherein a geometry of said collimator or of a collimator opening in said collimator can be adjusted in a non-operating state.

13. The X-ray optical element of claim 1, wherein said collimator is a further linear Soller slit.

14. The X-ray optical element of claim 13, wherein said Soller slit is a linear Soller slit, said linear Soller slit and said further linear Soller slid having different divergence angles.

15. The X-ray optical element of claim 1, wherein said collimator is a further radial Soller slit.

16. The X-ray optical element of claim 15, wherein said Soller slit is a radial Soller slit, said radial Soller slit and said further radial Soller slit having different opening angles and/or different divergence angles.

17. A diffractometer having a source for generating a primary beam, a sample holder for arranging a sample, a detector for detecting a secondary beam emitted by the sample, and the X-ray optical element of claim 1.

18. The diffractometer of claim 17, wherein the X-ray optical element is installed in the diffractometer in such a fashion that it can be rotated about an axis of rotation which is perpendicular to said axis of said Soller slit.

19. The diffractometer of claim 18, further comprising a motor for rotating the X-ray optical element.

20. The diffractometer of claim 18, further comprising automatic control or computer control of rotation of the X-ray optical element.

21. The diffractometer of claim 17, wherein the X-ray optical element is disposed on a side of the primary beam.

22. The diffractometer of claim 17, wherein the X-ray optical element is disposed on a side of the secondary beam.

23. The diffractometer of claim 22, wherein said detector is disposed in a point of intersection of the lamella directions of at least one radial Soller slit.

24. The diffractometer of claim 21, wherein said sample holder is disposed in a point of intersection of lamella directions of at least one radial Soller slit.

25. The diffractometer of claim 21, wherein said source is disposed in a center of at least one radial Soller slit.

* * * * *